US010529191B2

(12) United States Patent
Anderson et al.

(10) Patent No.: US 10,529,191 B2
(45) Date of Patent: Jan. 7, 2020

(54) ANONYMOUS FUNDING AND TRACKING OF SPORTS WAGERING ACROSS MULTIPLE DEVICES

(71) Applicant: BALLY GAMING, INC., Las Vegas, NV (US)

(72) Inventors: Peter R. Anderson, Northbrook, IL (US); Vladislav Modilevsky, Buffalo Grove, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 666 days.

(21) Appl. No.: 15/270,856

(22) Filed: Sep. 20, 2016

(65) Prior Publication Data

US 2017/0092076 A1 Mar. 30, 2017

Related U.S. Application Data

(60) Provisional application No. 62/232,603, filed on Sep. 25, 2015.

(51) Int. Cl.
*G07F 17/32* (2006.01)

(52) U.S. Cl.
CPC ..... *G07F 17/3288* (2013.01); *G07F 17/3211* (2013.01); *G07F 17/3225* (2013.01); *G07F 17/3241* (2013.01); *G07F 17/3246* (2013.01)

(58) Field of Classification Search
None
See application file for complete search history.

(56) References Cited

U.S. PATENT DOCUMENTS

| | | | | |
|---|---|---|---|---|
| 5,611,729 | A * | 3/1997 | Schumacher | G07F 17/3211 463/18 |
| 6,645,075 | B1 * | 11/2003 | Gatto | G07F 17/32 463/16 |
| 7,419,428 | B2 | 9/2008 | Rowe | A63F 13/00 |
| 8,128,485 | B2 | 3/2012 | Vlazny et al. | G06F 17/00 |
| 8,355,979 | B2 | 1/2013 | Capuano et al. | G06Q 40/00 |
| 8,417,626 | B2 | 4/2013 | Crosthwaite et al. | G06Q 40/00 |
| 8,602,874 | B2 | 12/2013 | Rowe et al. | G06F 17/00 |
| 8,876,608 | B2 | 11/2014 | Shepherd et al. | A63F 9/24 |
| 9,406,196 | B2 | 8/2016 | Asher et al. | G06F 17/00 |
| 10,297,105 | B2 * | 5/2019 | LeMay | G07F 17/3223 |

(Continued)

FOREIGN PATENT DOCUMENTS

WO WO 2016/115389 A1 7/2016 ..... A63F 9/24

*Primary Examiner* — Tramar Y Harper
(74) *Attorney, Agent, or Firm* — Michael Blankstein; Marvin A. Hein

(57) ABSTRACT

A gaming system includes a network accessible sports betting server that allows players to anonymously place wagers on sporting events using an anonymous account identifier that is not associated with any personal information of the player. The player may use the anonymous account identifier to access an available monetary balance for wagering, view, filter, and place wagers on sporting events using various wagering game machines, and continue to use the account identifier to track all associated wagering transactions while a remaining balance remains or pending wagering transactions are outstanding. The gaming system enables the player to use mobile devices and casino gaming machines to interchangeably interface with the anonymous account, viewing the remaining balance, place wagers, etc.

17 Claims, 14 Drawing Sheets

(56) References Cited

U.S. PATENT DOCUMENTS

2001/0036858 A1* 11/2001 McNutt ..... G06Q 30/02 463/25
2003/0045354 A1* 3/2003 Giobbi ..... G07F 17/32 463/40
2003/0078094 A1* 4/2003 Gatto ..... G07F 17/32 463/25
2003/0171145 A1* 9/2003 Rowe ..... G06Q 20/02 463/25
2005/0060231 A1* 3/2005 Soukup ..... G06Q 20/045 705/14.12
2005/0181876 A1* 8/2005 Vlazny ..... G06Q 20/363 463/42
2005/0227760 A1* 10/2005 Vlazny ..... G06Q 20/363 463/28
2007/0060326 A1* 3/2007 Juds ..... G07F 17/32 463/29
2007/0082730 A1* 4/2007 Brown ..... G07F 17/32 463/25
2007/0255643 A1 11/2007 Capuano et al. ..... G06Q 10/00
2008/0026823 A1* 1/2008 Wolf ..... G07F 17/32 463/25
2008/0076528 A1* 3/2008 Nguyen ..... G07F 17/32 463/25
2008/0214310 A1* 9/2008 Brunet De Courssou ..... G07F 17/32 463/42
2009/0042631 A1* 2/2009 Randhawa ..... G07F 17/32 463/17
2013/0045794 A1* 2/2013 Vlazny ..... G07F 17/32 463/25
2013/0065666 A1 3/2013 Schueller et al. ..... A63F 9/24
2014/0087853 A1 3/2014 Lemay et al. ..... G07F 17/32
2014/0323206 A1* 10/2014 Gagner ..... G07F 17/3248 463/25
2015/0339887 A1* 11/2015 Hong ..... G07F 17/3218 463/25
2015/0339888 A1 11/2015 Hong et al. ..... G07F 17/3248
2016/0049044 A1 2/2016 Ginsberg et al. ..... G07F 17/32
2016/0071373 A1 3/2016 Anderson et al. .. G07F 17/3246
2016/0086445 A1* 3/2016 Tsutsui ..... G07F 17/3248 463/25

* cited by examiner

410

Scientific Games

TERMINAL ID: 6354
2015/09/15 07:26:15 PM

BET SLIP

---

Calgary Stampeders VS. British Columbia Lions
18.09.2015 23:00
12 FT - Calgary Stampeders 1.1

---

Hamilton Tiger-Cats VS. Edmonton Eskimos
18.09.2015 18:00
12 FT - Hamilton Tiger-Cats 1.3

---

Saskatchewan Roughridiers VS. Ottowa Redblacks
19.09.2015 23:00
12 FT - Saskatchewan Roughridiers 1.75

---

---

Total Odds: 2.50
Total Stake: USD $20.00

---

Max Return: USD $50.00

For our Full Terms and Conditions please visit
http://www.scientificgames.com/

415

FIG. 4A

| E-ID # | TITO # | BET SLIP # | VALUE |
|---|---|---|---|
| 2354..1928 | 7631..1067 | 2608..8389 | $20 |
| | | 1667..2135 | $5 |
| | | 6323..8240 | $50 |
| | | 7503..6789 | $20 |
| 3624..2114 | 8431..9980 | 2783..4822 | $20 |
| | | 5182..0588 | $20 |
| 8001..8454 | 5893..6588 | 5729..1378 | $20 |
| | | 1690..3857 | $50 |
| | | 9429..1432 | $50 |
| | | 9005..7889 | $50 |

ANONYMOUS FUNDING AND TRACKING OF SPORTS WAGERING ACROSS MULTIPLE DEVICES

RELATED APPLICATIONS

This patent application claims the priority benefit of U.S. Provisional Patent Application Ser. No. 62/232,603, filed Sep. 25, 2015 and entitled "ANONYMOUS FUNDING AND TRACKING OF SPORTS WAGERING ACROSS MULTIPLE DEVICES," incorporated herein by reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming systems, apparatus, and methods and, more particularly, to a system and method for anonymous sports betting using casino kiosks and mobile devices.

BACKGROUND OF THE INVENTION

The registration of players as a requirement to wager in casinos is becoming more and more commonplace. Prior to placing wagers via wagering machines and/or mobile devices, players may be required to establish a network-accessible account and populate the account with money to cover the balance of future wagers. In the modern age of "big data" and nefarious network users, the storage of online data relating to player personal information, including financial information, involves significant risk to the player in the event that the security of such personal information is compromised. Further, many wagering players do not wish to have wagering patterns, physical movement, and casino activities tracked for the benefit of establishments or corporations.

Cashless wagering game systems have become commonplace in casinos. Instead of currency, cashless wagering game systems utilize cash substitutes, such as tickets, player identification cards, credit cards, etc. for transactions taking place during wagering gameplay. For example, when a player cashes out at the end of a wagering game session, the wagering game machine prints a ticket representing the credit meter's cash value at the time of cash out. The player can then take the ticket and insert it in another wagering game machine and begin gameplay. Additionally, the player can exchange the ticket for cash at a cashier or kiosk. Although cashless wagering game systems have many advantages, tickets can be easily lost, misplaced, stolen, etc. before the player is able to redeem them. Also, there is no recordation of the wagering events that occur during anonymous wagering game sessions associated with cashless tickets. The addition of subsequent wagering events correlating to anonymous cashless tickets are not easily managed or recorded in modern casinos.

SUMMARY OF THE INVENTION

According to one aspect of the present invention, a gaming system comprises a sports betting server coupled to a network. The sports betting server includes at least one processor, a communications interface configured to communicate via the network, and a memory storage device configured to store instructions causing the sports betting server to perform a set of functions. The sports betting server is configured to establish an anonymous account with a balance corresponding to received cash from a player via a bill acceptor of a kiosk. The anonymous account is associated with an identifier and is unassociated with any personal information of the player. The balance for the anonymous account is transmitted from the kiosk to the sports betting server via the network. The sports betting server receives the identifier from a first wagering terminal via the network, enabling access to the anonymous account. The sports betting server also receives from the first wagering terminal via the network a first wager on a first sporting event covered by the balance in the anonymous account. The sports betting server receives the identifier from a second wagering terminal via the network, again enabling access to the anonymous account, and the sports betting server receives a second wager (covered by a remaining balance in the anonymous account) on a second sporting event from the second wagering terminal via the network.

According to one aspect of the present invention, a gaming system comprises a sports betting kiosk including an electronic display device, a bill acceptor, and a controller. The controller is configured to accepting cash from a player via the bill acceptor and transmit balance information to a remote server. The remote server establishes an anonymous account with a balance corresponding to the received cash. The anonymous account is associated with an identifier and is unassociated with any personal information of the player. The sports betting kiosk delivers the identifier to the player. The identifier is receivable at a first wagering terminal to enable access to the anonymous account and obtain receipt of a first wager (covered by the balance in the anonymous account) on a first sporting event. The sports betting kiosk receives the identifier to enable access to the anonymous account, and receives a second wager (covered by a remaining balance in the anonymous account) on a second sporting event.

According to another aspect of the invention, a computer-implemented method in a gaming system comprises operating a sports betting system. The method comprises accepting cash from a player via a bill acceptor and subsequently causing a controller to establish an anonymous account with a balance corresponding to the received cash. The anonymous account is associated with an identifier and is unassociated with any personal information of the player. The identifier is delivered to the player. The identifier is received at a first wagering terminal to enable access to the anonymous account. A first wager (covered by the balance in the anonymous account) on a first sporting event is received via the first wagering terminal. The identifier is received at a second wagering terminal to enable access to the anonymous account. A second wager (covered by a remaining balance in the anonymous account) on a second sporting event is then received via the second wagering terminal.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

FIG. 4A is an image of an exemplary betting slip generated by a gaming machine, according to an embodiment of the present invention.

Figure 1:
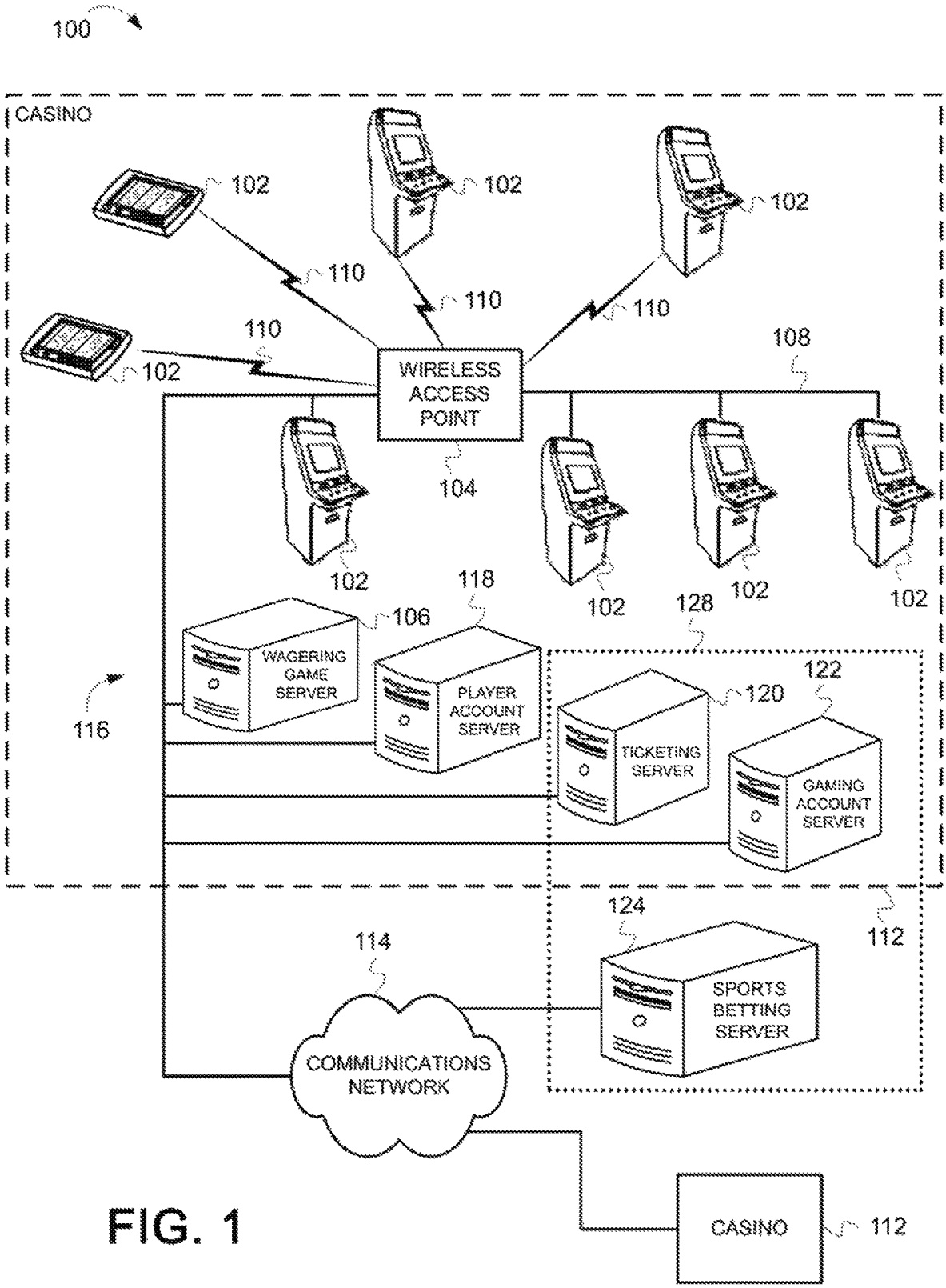
FIG. 1 is a schematic block diagram illustrating a wagering game network 100, according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated. For purposes of the present detailed description, the singular includes the plural and vice versa (unless specifically disclaimed); the words "and" and "or" shall be both conjunctive and disjunctive; the word "all" means "any and all"; the word "any" means "any and all"; and the word "including" means "including without limitation."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

FIG. 1 is a block diagram illustrating a wagering game network 100, according to example embodiments of the invention. As shown in FIG. 1, the wagering game network 100 includes a plurality of casinos 112 connected to a communications network 114.

Each casino 112 includes a local area network 116, which includes wagering game machines 102, an access point 104, a wagering game server 106, a player account server 118, a ticketing server 120, and a gaming account server 122. The access point 104 provides wireless communication links 110 and wired communication links 108. The wired and wireless communication links can employ any suitable connection technology, such as Bluetooth, 802.11, Ethernet, public switched telephone networks, SONET, etc. In some embodiments, the wagering game server 106 can serve wagering games and distribute content to devices located in other casinos 112 or at other locations on the communications network 114.

The wagering game machines 102 described herein can take any suitable form, such as floor standing models, kiosks, handheld mobile units, bartop models, workstation-type console models, etc. Further, the wagering game machines 102 can be primarily dedicated for use in conducting wagering games, or can include non-dedicated devices, such as mobile phones, personal digital assistants, personal computers, tablets, etc. In one embodiment, the wagering game network 100 can include other network devices, such as additional accounting servers, wide area progressive servers, player tracking servers, and/or other devices suitable for use in connection with embodiments of the invention.

In some embodiments, wagering game machines 102 and wagering game servers 106 work together such that a wagering game machine 102 can be operated as a thin, thick, or intermediate client. For example, one or more elements of game play may be controlled by the wagering game machine 102 (client) or the wagering game server 106 (server). Game play elements can include executable game code, lookup tables, configuration files, game outcome, audio or visual representations of the game, game assets, graphical user interfaces, or the like. In a thin-client example, the wagering game server 106 can perform functions such as determining wagering game outcomes or managing assets, while the wagering game machine 102 can present a graphical representation of such outcome or asset modification to the user (e.g., player). In a thick-client example, the wagering game machines 102 can determine game outcomes and communicate the outcomes to the wagering game server 106 for recording or managing a player's account.

In some embodiments, either the wagering game machines 102 (client) or the wagering game server 106 can provide functionality that is not directly related to game play. For example, account transactions and account rules may be managed centrally (e.g., by the wagering game server 106) or locally (e.g., by the wagering game machine 102). Other functionality not directly related to game play may include power management, presentation of advertising, software or firmware updates, system quality or security checks, etc.

Additionally, in some embodiments, the player account server 118 can store and provide access to player accounts in one or more databases, for example, maintaining information associated with a player profile or preferences.

Information may also include player tracking information, amount spent, player card points, etc.

In some embodiments, the ticket server 120 provides functionality relating to wagering game tickets, such as verifying wagering game tickets, producing wagering game tickets, determining monetary value associated with wagering game tickets, etc. The ticket server 120 may include transactional processing relating directly to "ticket-in and ticket-out" (TITO) operations, where a ticket or other receipt is printed at a kiosk, gaming terminal, or even a peripheral connected to a mobile device to move or transfer credits and/or monetary value between machines using the printed ticket. In other embodiments, electronic devices (including client devices, non-volatile storage devices, passive transponders, etc.) may be used to provide identifiers for transactional transfers between electronic computing devices.

In one embodiment, the gaming account server 122 and the sports betting server 124 are part of a common network server entity (a casino accounting system 128) that performs the collective functions of both servers. That is, the casino accounting system 128 may use the gaming account server 122 for managing one or more databases to maintain a set of identification numbers corresponding to anonymous accounts and the sports betting server 124 may be used to provide functionality relating to managing lists of sporting events (e.g., completed, in-progress, and upcoming sporting events), sporting event wagering, sporting event multimedia playback, etc. Alternatively, the gaming account server 122 and the sports betting server 124 may be different systems that perform the respective methods separately.

Any or all of the network server services (e.g., the casino accounting system 128) may include any number of physical machines, having any number of associated processors and controllers, any number of communications interfaces configured to communicate with the network, and access to a memory storage device configured to store instructions, which when executed by at least one processor, cause the casino accounting system to perform various described functions. For example, the casino accounting system 128 may comprise any combination of the disclosed functional network server services described herein.

Further, while the wagering game server 106, the player account server 118, the ticketing server 120, the gaming account server 122, and the sports betting server 124 are each portrayed as a single computing physical entity, each of these sub-systems may include one or more physical machines connectively coupled via one or more networks that work collectively to fulfill their recited function. Also, the wagering game server 106, the player account server 118, and the ticketing server 120, shown as coupled directly to the communicative links 108, 110 of the casino 112, may alternatively be communicatively coupled to network 114 in a location remote from casino 112. Likewise, the sports betting server 124 may be directly coupled to the casino 112 via communicative links 108, 110, for example, positioned on the physical campus of the casino.

In one embodiment, the casino accounting system 128 operates to correlate an anonymous account identifier with a remaining associated balance of the anonymous account specified by a corresponding TITO identifier, and set of bet slip identifiers. The player account server 118, the gaming account server 122, and/or the sports betting server 124 may work collectively to maintain anonymous account information that is unassociated with any personal information of the player. The casino accounting system 128 may be a single network server operating to perform all the operations of all the included functional components. Any of the wagering game network components (e.g., the wagering game machines 102, servers 106, 118, 120, 122, etc.) may include hardware and machine-readable media including instructions for performing any or all of the operations described herein.

This application also includes content matter that is similarly described in co-pending patent application Ser. No. 14/852,231, to Anderson et al., filed Sep. 11, 2015, which is fully incorporated by reference in its entirety. This co-pending application shares a number of network entities and methodologies for managing information stored on various network dispersed entities (e.g., servers 106, 118, 120, 122, etc.), and the communication between network entities.

Figure 2:
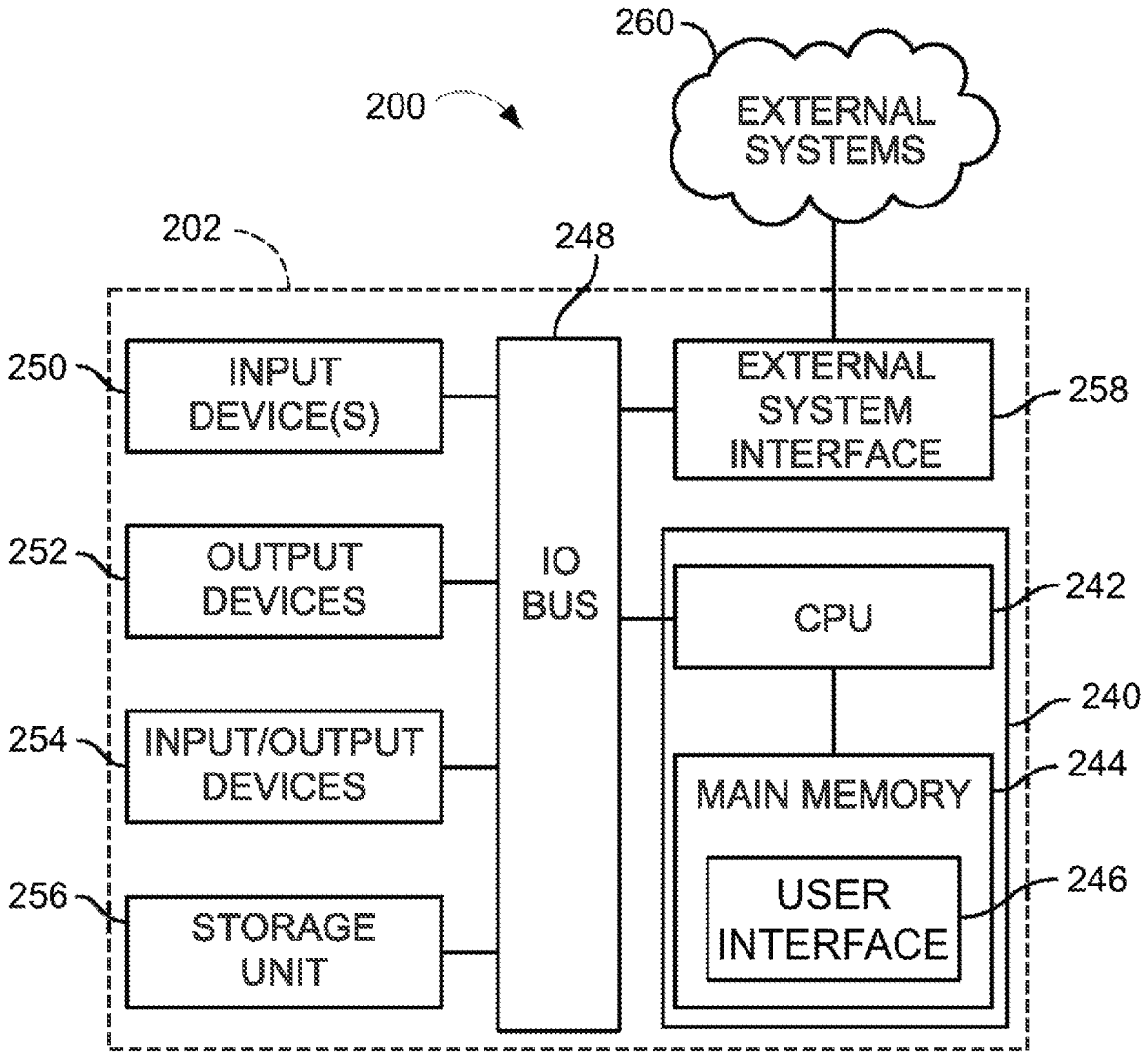
FIG. 2 is a schematic view of a gaming system according to an embodiment of the present invention.

Turning now to FIG. 2, there is shown a block diagram of the wagering gaming machine architecture 200 according to one embodiment. The gaming machine 202 includes game-logic circuitry 240 having a central processing unit (CPU) 242 connected to a main memory 244 that comprises one or more memory devices. The CPU 242 includes any suitable processor(s), such as those made by Intel and AMD. By way of example, the CPU 242 includes a plurality of microprocessors including a master processor, a slave processor, and a secondary or parallel processor. The game-logic circuitry 240, as used herein, comprises any combination of hardware, software, or firmware disposed in or outside of the gaming machine 202 that is configured to communicate with or control the transfer of data between the gaming machine 202 and a bus, another computer, processor, device, service, or network (e.g., network 108, 110, 114, etc.). The game-logic circuitry 240, and more specifically the CPU 242, comprises one or more controllers or processors and such one or more controllers or processors need not be disposed proximal to one another and may be located in different devices or in different locations. The game-logic circuitry 240, and more specifically the main memory 244, comprises one or more memory devices which need not be disposed proximal to one another and may be located in different devices or in different locations. The game-logic circuitry 240 is operable to execute all of the various gaming methods and other processes disclosed herein that may span multiple devices, e.g., the wagering machines 102, servers 106, 118, 120, 122, 124, etc. The main memory 244 includes a user-interface unit 246. In one embodiment, the user-interface unit 246 causes a graphical user (player) interface to be presented on the machine 202, that may include presentation for one or more wagering games such as video poker, video black jack, video slots, video lottery, etc., in whole or part, in addition to a player interface allowing the player to interact with other components of the system including wagering games or application executing on the wagering game server 106, the player account server 118, the ticketing server 120, and the sports betting server 124, among others.

The game-logic circuitry 240 is also connected to an input/output (I/O) bus 248, which can include any suitable bus technologies, such as an AGTL+ frontside bus and a PCI backside bus. The I/O bus 248 is connected to various input devices 250, output devices 252, and input/output devices 254.

By way of example, input devices 250 may include one or more touch screens mounted over one or more displays, physical buttons on a button panel, a mouse, a joystick, a gesture-sensing device, a voice-recognition device, a bill/ticket acceptor, a card reader, radio-frequency identification (RFID) readers, or any other piece of electronic equipment that provides signals in response to changing configuration of the input device. For example, an input device 250 may be configured to accept player inputs and transform the player inputs to electronic data signals indicative of the player inputs. The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element. Other types of input devices 250 may include optical scanners, cameras, etc., used to recognize bar codes that may be used to correlate to one or more database entries residing on one or more accessible network servers.

The output devices 252 may include electronic devices to display or provide information in one form or another. For example, output devices 252 may include one or more displays, one or more audio speakers that provide information associated with wagering games, non-wagering games, community games, progressives, advertisements, services, premium entertainment, text messaging, emails, alerts, announcements, broadcast information, subscription information, etc., appropriate to the particular mode(s) of operation of the gaming machine 202. Additionally, a card writer, a ticket dispenser, and player-accessible ports (e.g., audio output jack for headphones, video headset jack, USB port, wireless transmitter/receiver, etc.), may also be implemented. It should be understood that numerous other peripheral devices and other elements exist and are readily utilizable in any number of combinations to create various forms of a gaming machine in accord with the present concepts.

Input/output devices 254 that include both input and output functionality are likewise inclusive of a variety of electronic devices coupled to the gaming machine 202.

The gaming machine 202 may also include one or more input and/or output devices that serve as value input/payment devices and value output/payout devices. In order to deposit cash or credits for wagering, the value input devices are configured to detect a physical item associated with a monetary value that establishes a credit balance on a credit meter such as the "credits" meter 310 (see FIG. 3A). The physical item may, for example, be currency bills, coins, tickets, vouchers, coupons, cards, and/or computer-readable storage mediums. The deposited cash or credits are used to fund wagers placed on the wagering game played via the gaming machine 202. Examples of value input devices include, but are not limited to, a coin acceptor, a bill/ticket acceptor, a card reader/writer, an image scanning device, a wireless communication interface for reading cash or credit data from a nearby mobile device, and a network interface for withdrawing cash or credits from a remote account via an electronic funds transfer. In response to a cashout input that initiates a payout from the credit balance on the "credits" meter 310 (see FIG. 3A), the value output devices may be used to dispense cash, credits, or tickets, vouchers, etc., from the gaming machine 202. The tickets or vouchers may indicate an amount of credits that may be exchanged for cash at, for example, a cashier or redemption station. Examples of value output devices include, but are not limited to, a coin hopper for dispensing coins or tokens, a bill dispenser, a card reader/writer, a ticket dispenser for printing tickets redeemable for cash or credits, a wireless communication interface for transmitting cash or credit data to a nearby mobile device, and a network interface for depositing cash or credits to a remote account via an electronic funds transfer.

The I/O bus 248 of the gaming machine 202 is also connected to a storage unit 256 and an external-system interface 258, which is connected to external system(s) 260 (e.g., wagering-game networks 108, 110, 114, etc.). The external system 260 includes, in various aspects, a gaming network, other gaming machines or terminals, one or more gaming servers, a remote controller, communications hardware, or a variety of other interfaced systems or components, in any combination. In yet other aspects, the external system 260 comprises a portable electronic device (e.g., cellular phone, electronic wallet, etc.) and the external-system interface 258 is configured to facilitate wireless communication and data transfer between the portable electronic device and the gaming machine 202, such as by a near-field communication path operating via magnetic-field induction or a frequency-hopping spread spectrum RF signals (e.g., Bluetooth, etc.).

The gaming machine 202 optionally communicates with the external system 60 such that the gaming machine 202 operates as a thin, thick, or intermediate client. The game-logic circuitry 240—whether located within ("thick client"), external to ("thin client"), or distributed both within and external to ("intermediate client") the gaming machine 202—is utilized to provide and/or present an interface to a wagering game gaming machine 202. In some instances, the main memory 244 may store programming for a random number generator (RNG), game-outcome logic, and game assets (e.g., art, sound, etc.)—all of which obtained regulatory approval from a gaming control board or commission and are verified by a trusted authentication program in the main memory 244 prior to game execution. The authentication program generates a live authentication code (e.g., digital signature or hash) from the memory contents and compare it to a trusted code stored in the main memory 244. If the codes match, authentication is deemed a success and the game is permitted to execute. If, however, the codes do not match, authentication is deemed a failure that must be corrected prior to game execution. Without this predictable and repeatable authentication, the gaming machine 202, external system 260, or both are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

In some embodiments, when a wagering-game instance is executed, the CPU 242 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 242 when executing the game-outcome logic to determine a resultant outcome for that instance of the wagering game. The resultant outcome is then presented to a player of the gaming machine 202 by accessing the associated game assets, required for the resultant outcome, from the main memory 244. The CPU 242 causes the game assets to be presented to the player as outputs from the gaming machine 210 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game in such instances.

The gaming machine 202 may also be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

In other embodiments, wagering games include wagering on the results of sporting events or other events that do not require any random number generation. The results of the events may be maintained by a secure source (e.g., wagering game server 106, sports betting server 124, etc.) and used by the game-logic circuitry 240 to determine the suitable outcomes of the wagering game.

The gaming machine 202 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

For each data signal, the game-logic circuitry 240 is configured to process the electronic data signal, to interpret the data signal (e.g., data signals corresponding to a wager input), and to cause further actions associated with the interpretation of the signal in accord with stored instructions relating to such further actions executed by the controller.

In one embodiment, the gaming machine 202 and, additionally or alternatively, the external system 260 (e.g., a gaming server), means gaming equipment that meets the hardware and software requirements for fairness, security, and predictability as established by at least one state's gaming control board or commission. Prior to commercial deployment, the gaming machine 202, the external system 260, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 202 may be implemented with hardware and software architectures, circuitry, and other special features that differentiate it from general-purpose computers (e.g., desktop PCs, laptops, and tablets).

Figure 3A:
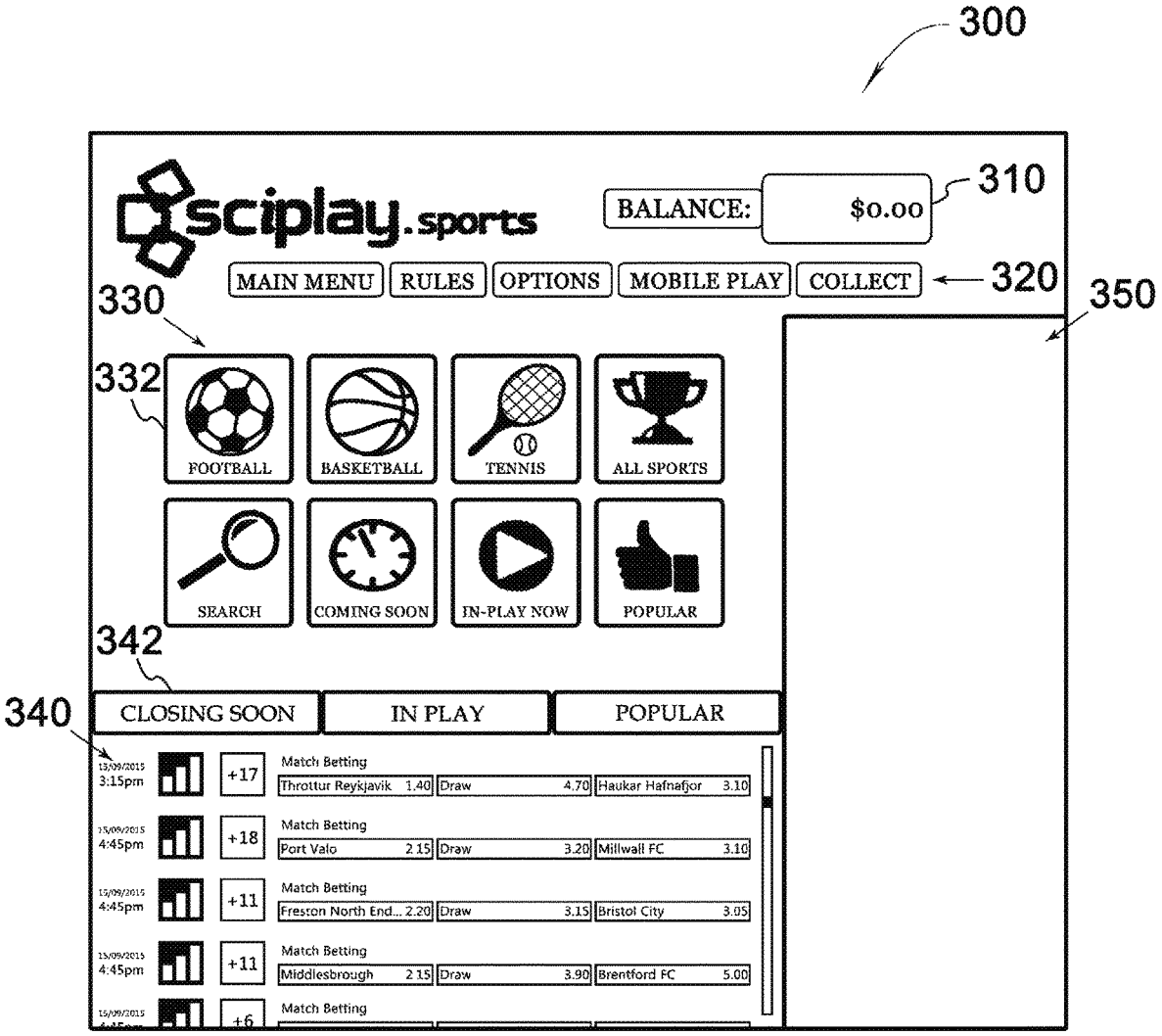
FIG. 3A-3D are images of an exemplary player interface displayed on a gaming machine, according to an embodiment of the present invention.

Referring now to FIG. 3A, an illustrated image of an interface 300 displayed on one or more of the gaming machines 102 according to one embodiment. The interface 300 enables a player to interact with the wagering game server 106, the player account server 118, the ticketing server 120, the sports betting server 124, and even other gaming machines 102 to participate in a wagering game. The interface 300 may be displayed on one or more of the output devices (e.g., output display device 252) on a wagering game machine 102, for example, a kiosk or a tablet.

The interface 300 advantageously displays one or more credit meters 310, an options menu 320, an icon menu 330, an event list 340, and an advertisement space 350. The credit meter 310 reflects a current credit balance available to the player of the gaming machine 102 for wagering. The options menu 320 provides virtual buttons corresponding to selectable options that are available to the player for changing presentation settings, getting help, and/or terminating the gaming session using the appropriate virtual buttons.

The icon menu 330 contains graphical icons 332 corresponding to filters that control the display of the elements displayed in the event list 340. The display elements of the event list 340 can be sorted and limited using filter buttons 342. The event list 340 displays a list of sporting events that may be selected for placing wagering upon.

The advertisement space 350 may display advertisements that promote specific events, games, or offer casino-related services to the player. Control of the display of content and information in the space 350 may be driven by decisions of the wagering game server 106, player account server 118, gaming account server 122, or an additional network entity including the sports betting server 122 or another network entity (e.g., an advertisement server, not shown)

The credit meter 310 displayed in FIG. 3A indicates that there is currently no available monetary value balance to cover wagers. In one example, a player at a kiosk may use an input device (e.g., a bill acceptor) of the kiosk to insert or display a physical item associated with monetary value (e.g., bills) to establish a balance corresponding to the received item. In another embodiment, the physical item is a ticket or voucher that is presented, scanned, and verified, and is associated with a particular value. Using modern "ticket-in, ticket out" (TITO) systems, a TITO identifier is created at the time the ticket is printed that corresponds to the monetary value of the ticket so that the value of the ticket or voucher can be properly verified by one or more network entities. Upon presentation of the TITO ticket (i.e., at a kiosk), the TITO identifier may be used to lookup the value of the TITO identifier on the network by accessing the necessary server(s), and increment the credit meter accordingly. In some cases, the TITO identifier is then marked invalid, and/or a "zero" balance is recorded in the network entity as being associated with that TITO identifier to preclude the ticket from being redeemed more than once.

Figure 3B:
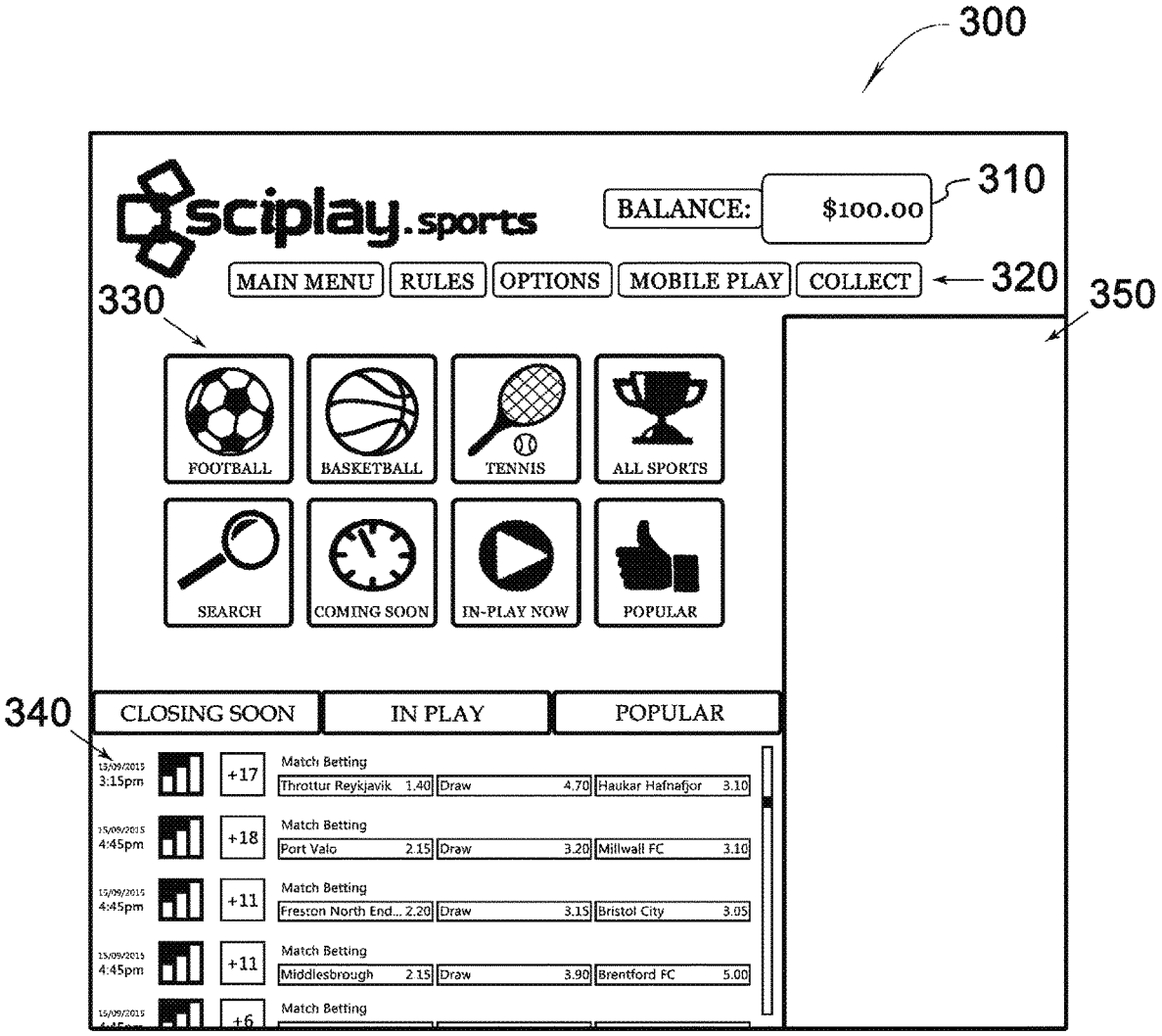

Referring now to FIG. 3B, after the addition of funds for wagering is performed by the gaming machine 102, an updated credit meter 310 is displayed as part of the interface 300 to reflect the updated balance. The balance indicates funds available that may be used to cover wagers using the interface 300.

Figure 3C:
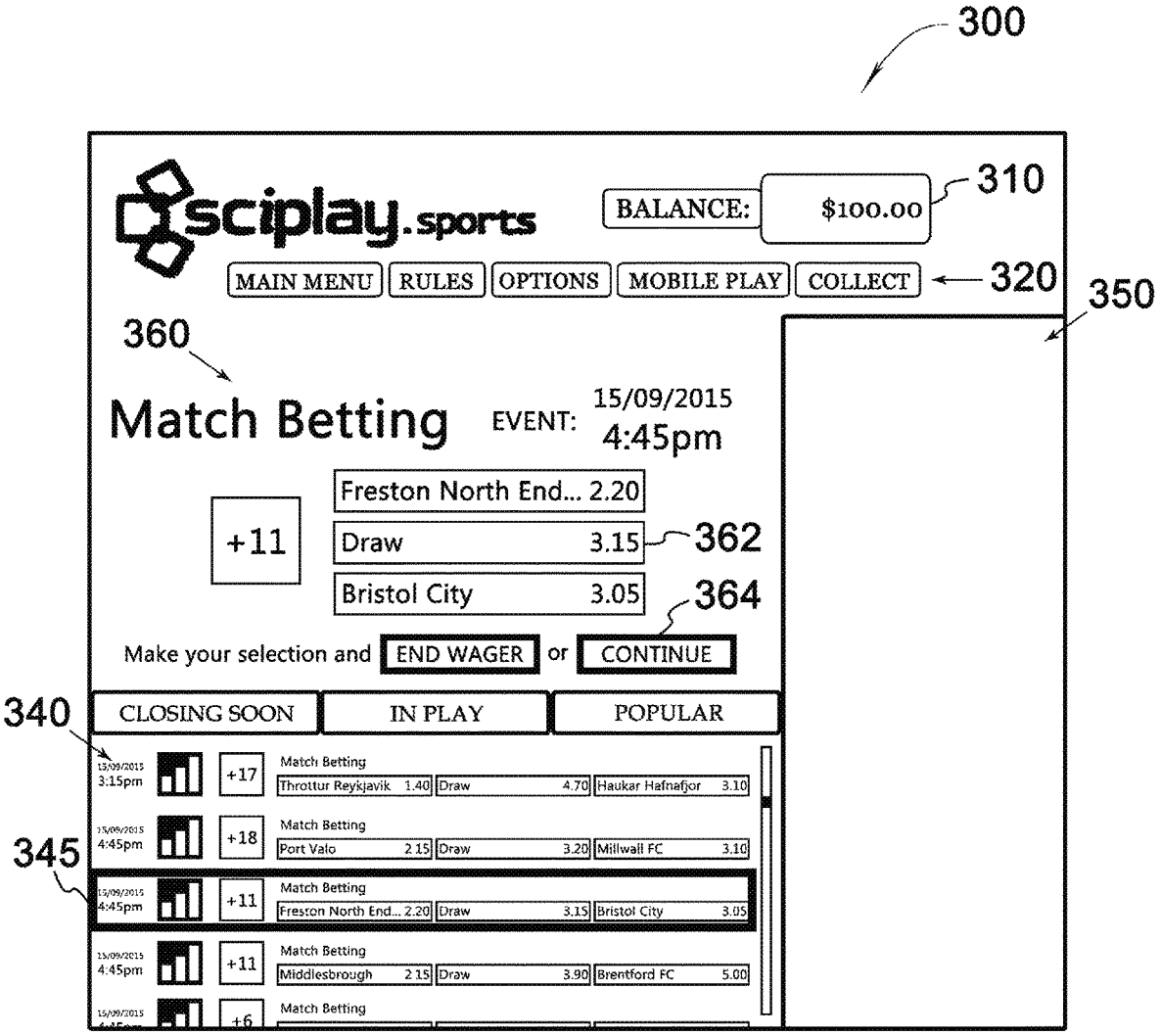

Referring now to FIG. 3C, the interface 300 additionally includes a wagering menu 360 to facilitate the player to place wagers. Upon selection of a specific event entry 345 in the event list 340, the wagering menu 360 is presented having wagering selection buttons 362, 364. After selection and verification of the selected event (e.g., using the buttons 362 and/or an additional confirmation prompt, not shown), a summary of the intended wager may be provided on the interface 300 to particularly specify the event. Multiple events may be simultaneously or sequentially selected as part of a single wager using additional screens. For instance, a player may desire to place a single wager on the collective outcome of three different sporting events. This may be achieved using buttons 364 in conjunction with additional, subsequent interface screens (not shown). Once the player selects the desired event(s) that a wager will be placed on, the player uses button 364 to finalize the selected events and is presented with an interface to select an amount for wager.

Figure 3D:
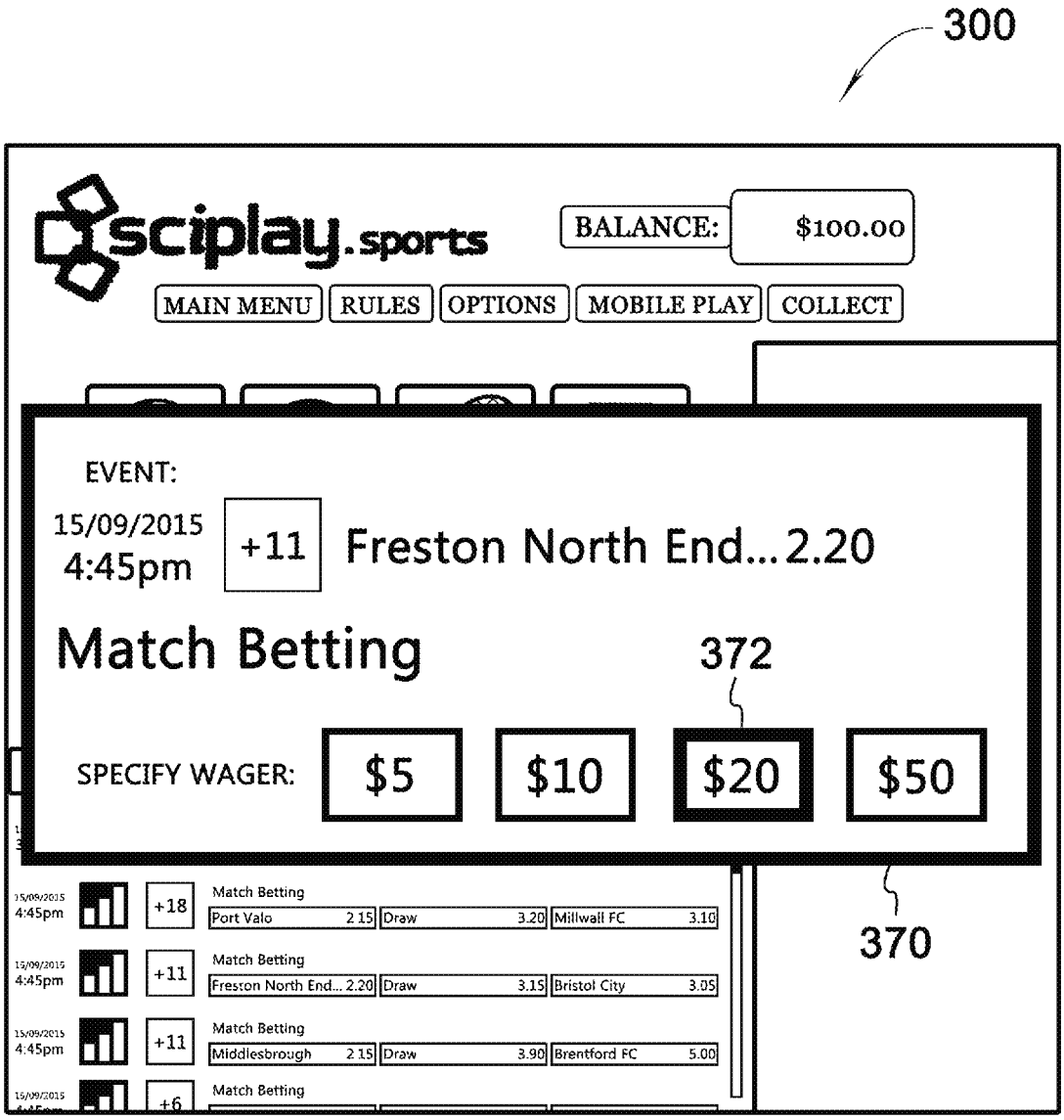

Referring now to FIG. 3D, the interface 300 presents a summary and bet placement interface 370. The interface 370 includes details corresponding to the intended wagering event and wager amount buttons 372. The button 372 enable the player to specify an amount of the wager. Additional confirmation screens or prompts may be provided in response to selection of one or more of the buttons 372 for verification and presentation.

The wagered amount is deducted from the meter 310 to reflect the new current balance of the account. The balance may be used for performing additional wagers or be converted into bills or coins, a ticket voucher, additional account identification, etc., for transfer for funds to the player.

Referring now to FIG. 4A, a bet slip 410 is shown as generated by the selections of a player using the interface 300 in one embodiment. The bet slip 410 recites various information directly related to the wager. For example, the bet slip displays the sporting events that are part of the player's wager, the amount of the wager, and the maximum payoff amount for the wager.

The bet slip 410 includes a bar code 415 that corresponds to an electronic tracking identifier ("E-tracking ID") specifying an anonymous account managed by the casino accounting system 128 of the gaming system. The bet slip 410 is the result of player interaction with a kiosk (or other wagering game machine 102 with a printing device) of the wagering system. That is, the bet slip 410 is physically printed by an output device of the kiosk.

Alternatively, a virtual bet slip may be generated that displays, provides, or otherwise delivers the E-tracking ID to the player, whether it be in textual form, bar code form, or some other encoded format. A virtual bet slip specifies the wagering transaction in its entirety and is associated with the anonymous player account specified by the E-tracking ID that is used to fund the wager.

The E-tracking ID may be a numerical code, an alphanumerical code, or some other type of encoded image or designation, including textual codes (e.g., account numbers or unique resource locators (URLs)), barcodes (e.g., one-dimensional (1D) linear barcodes, two-dimensional (2D) matrix barcodes, etc.), a unique alphabetic code, a unique numeric code, a unique alphanumeric code, short-message-service (SMS) codes, other visual imagery, etc. Thus, the E-tracking ID identifier may be delivered to the player via a variety of different methods. Among these, sending a text message or electronic mail containing the identifier, displaying the identifier on a video display, audibly, printing a ticket bearing the code representing the identifier, etc.

The co-pending patent application Ser. No. 14/852,231, to Anderson et al., filed Sep. 11, 2015, which is fully incorporated by reference in its entirety, includes discussion and description of E-tracking IDs, e-tickets, e-ticket scanning systems, e-ticket usage on mobile devices, components of the casino accounting system, etc., that may be relied on to fully adapt the operation of the disclosed invention.

Figure 4B:
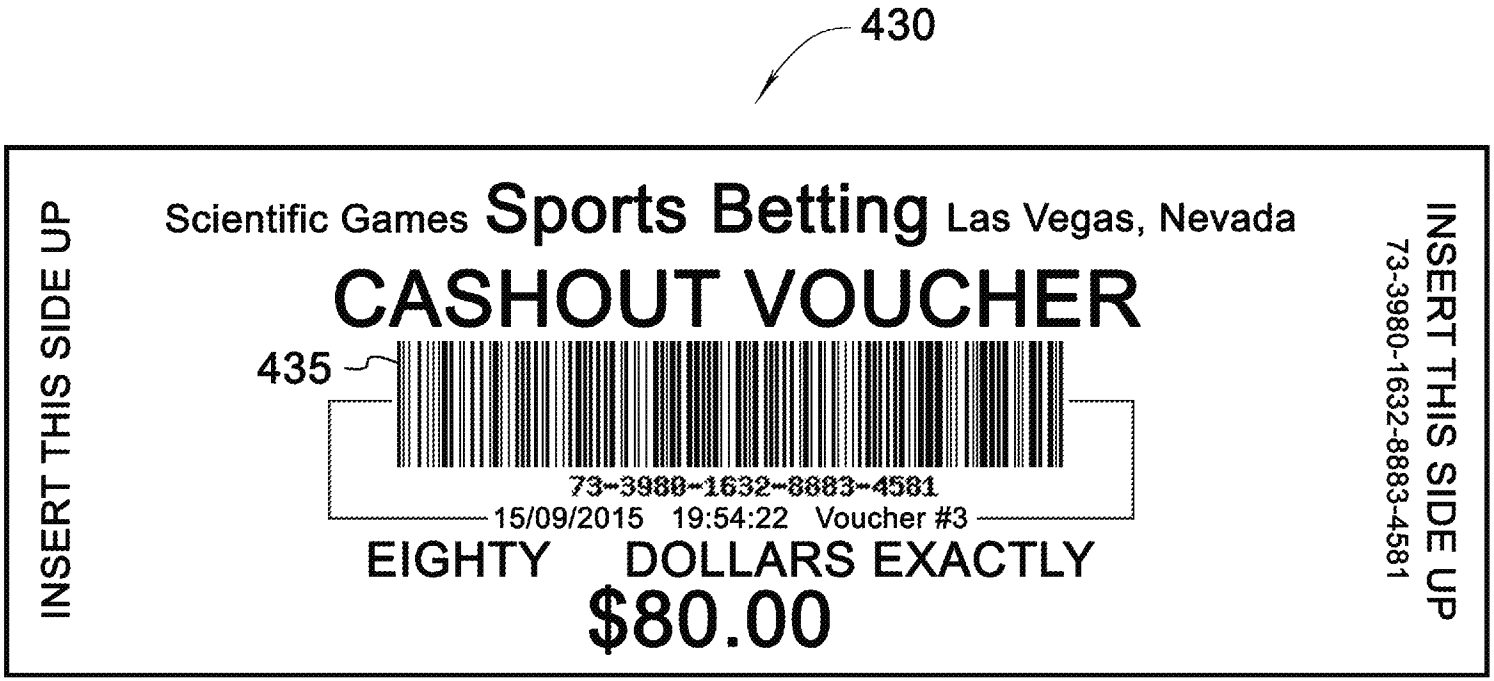
FIG. 4B is an image of an exemplary ticket-in/ticket-out voucher generated by a gaming machine, according to an embodiment of the present invention.

Referring now to FIG. 4B, a voucher 430 is shown in one embodiment. For example, in response to the player selecting the "COLLECT" virtual button from the menu interface 320 on the interface 300 presented on a kiosk (or a physical "COLLECT" or "CASHOUT" button available on any wagering machine 102), the barcode 435 is electronically generated to correspond to the balance of the credit meter. The voucher 430 is printed at the kiosk, allowing the player to use the voucher to retrieve cash (e.g., via a cash dispensing machine or casino teller), or transfer the value specified on the voucher into another wagering game machine 102 for further wagering. In one embodiment, the barcode 435 of the voucher 430 specifies a TITO identifier that corresponds to a particular monetary amount that may be used for transfer of funds other gaming machines 102, for example, a kiosk or other wagering terminal. The voucher 430 may or may not have an E-tracking ID associated therewith. In the event that the TITO identifier is associated with an E-tracking ID, a corresponding entry in the database of the casino accounting system 128 is designated.

Figure 4C:
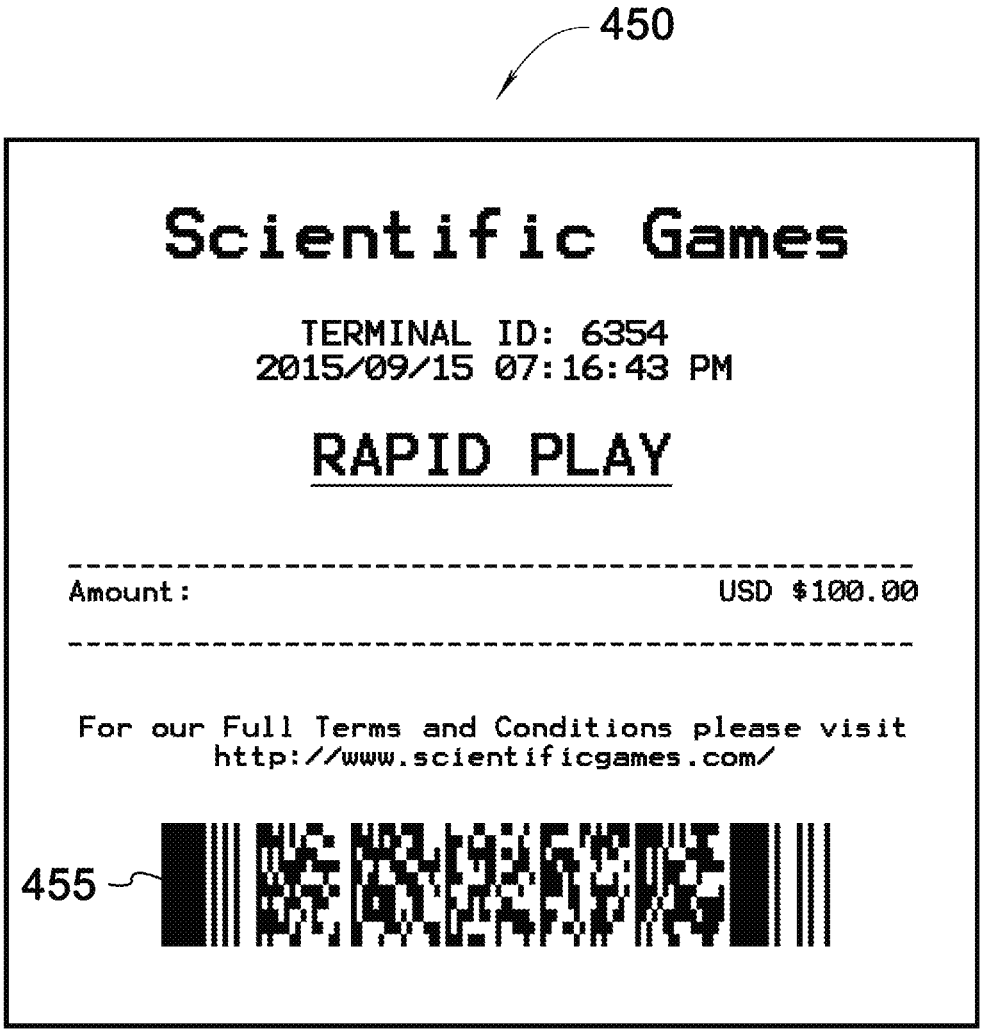
FIG. 4C is an image of an exemplary balance receipt and anonymous account identification ticket generated by a gaming machine, according to an embodiment of the present invention.

Referring now to FIG. 4C, a ticket 450 reflecting a monetary value is shown in one embodiment. The ticket 450 is different from the voucher 430 in that the ticket 450 may be used to transfer the corresponding funds to a mobile device for wagering thereon. The ticket 450 includes a barcode 455 encoding (or corresponding to) an E-tracking ID that may be associated with a TITO identifier specifying an amount of value for the ticket 450. The ticket 450 may be presented to a mobile device and scanned to enable the mobile device to query the casino accounting system to retrieve the credit balance associated with any corresponding TITO identifier balance.

The use of a wagering game machine 102 to make funds available for anonymous play of wagering games may include a variety of methods and may rely upon one or more methodologies. In one embodiment, a kiosk is used to present an interface to a player for management of funds transfer and wagering (e.g., wagering interface 300). The kiosk includes a value input device for making funds available for wagering and a value output device for providing a payout from the credit balance when a cashout input is received. A cash input may be made at the kiosk using a value-input device (e.g., a player enters cash into cash receiving devices, initiates an electronic cash transaction, scans a ticket or coupon code, swipes a gift card, initiates an electronic funds transfer, etc.).

In response, one or more gaming servers (e.g., ticketing server 120, gaming account server 122, etc.) detects an amount of the cash input and generates a unique tracking identifier for the funds. The gaming server communicates with one or more network entities (e.g., the casino accounting system 128), such as one that utilizes the Slot Accounting System ("SAS") protocol by International Game Technology (IGT) or the Game to System (G2S) protocol by the Gaming Standards Association. The casino accounting system 128 may include and utilize multiple network services (e.g., player account server 118, ticketing server 120, gaming account server 122, etc.) to perform the described functions. One such example of a casino accounting system is the Ticket-In/Ticket-Out ("TITO") System, which uses the aforementioned TITO technology. The casino accounting system 128 stores the amount of the cash input as a monetary value associated with a corresponding identifier (e.g., a TITO identifier). The gaming account server 122 associates the TITO identifier with the unique tracking identifier for the anonymous player account. The casino accounting system 128 (e.g., the gaming account server 122 or sports betting server 124) communicates the unique tracking identifier (e.g., E-tracking ID) to the casino kiosk. A mobile device may additionally link with the kiosk (or casino network at large) using the unique tracking identifier and may also specify an additional mobile device identifier to record device interaction. The casino accounting system 128 may communicate with one or more other elements (e.g., the gaming account server 122 or other network entities) to obtain the monetary value for the cash input and store it for future use in association with the anonymous player account. Thereafter, the casino accounting system 128 responds to communication with the kiosk and the mobile device using the unique tracking identifier. Further interactions may also occur that use the unique tracking identifier, including the presentation of bet slips associated with the unique tracking identifier.

Figure 5A:
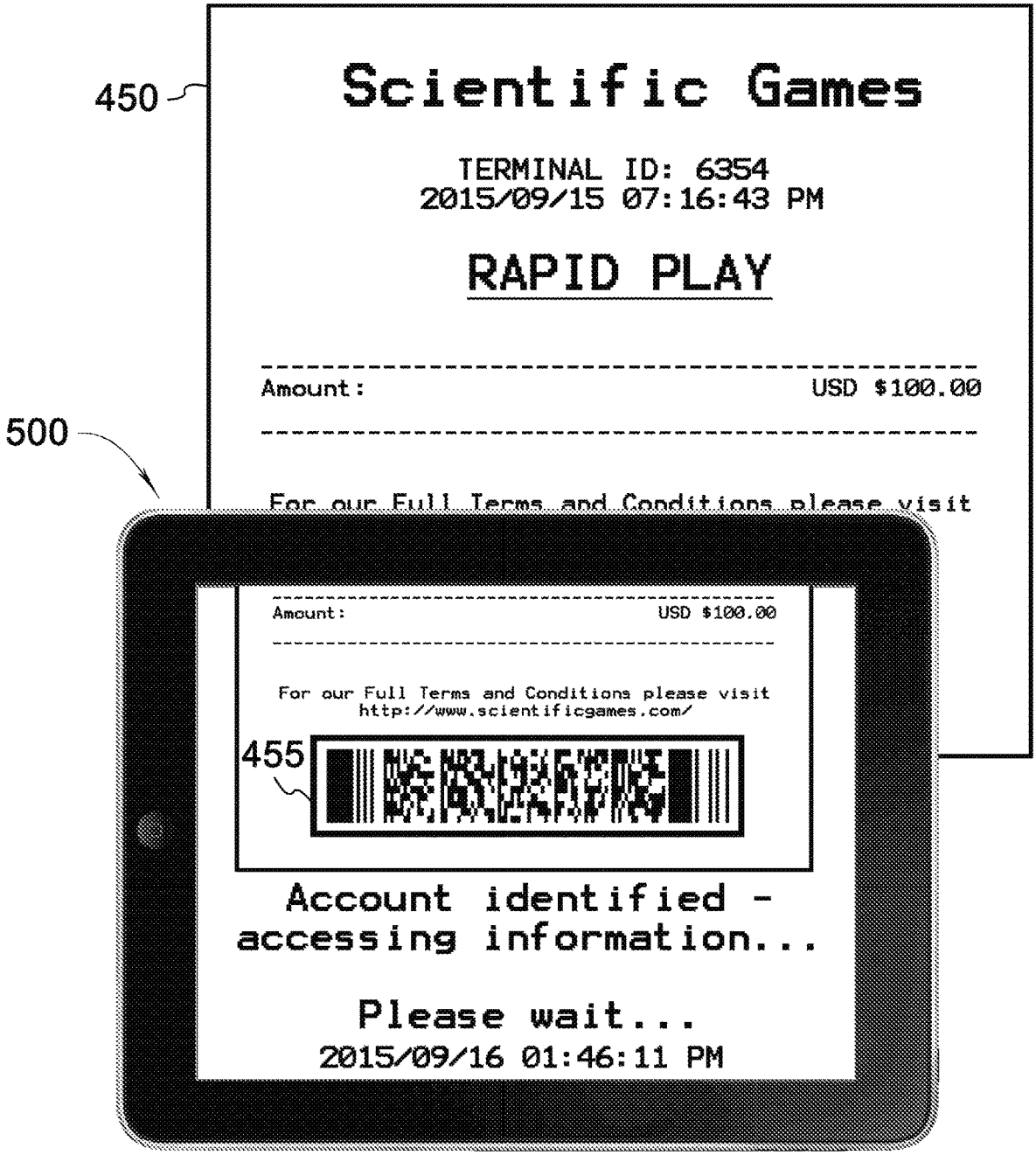
FIG. 5A is an image of an exemplary gaming machine scanning an anonymous account identification ticket, according to an embodiment of the present invention.

Referring now to FIG. 5A, a mobile device tablet 500, one such wagering game machine 102, is shown scanning a ticket 450 in one embodiment. The ticket 450 is presented to the tablet 500 enabling the tablet 500 to obtain the E-tracking ID encoded in the barcode 455. The E-tracking ID specifies an anonymous player account that may include previous wagering transactions, i.e., other associated bet slips (e.g., FIG. 4A). Future wagering transactions during this player gaming session will generate an additional (virtual) bet slip for each wagering transaction that is associated with the E-tracking ID. The virtual bet slips are stored in a database of the casino accounting system 128 and associated with the E-tracking ID and TITO identifier (if any) of the corresponding anonymous player account.

In one embodiment, the tablet 500 scans and sends the image of the ticket 450 to a network service (e.g., the ticketing server 120), to processes the image, obtains the encoded information (e.g., monetary value associated with the ticket, player account number, E-tracking ID, etc.) and communicates with other network services (e.g., the casino accounting system 128) to obtain desired related information (associated bet slips, TITO identifiers, etc.).

Figure 5B:
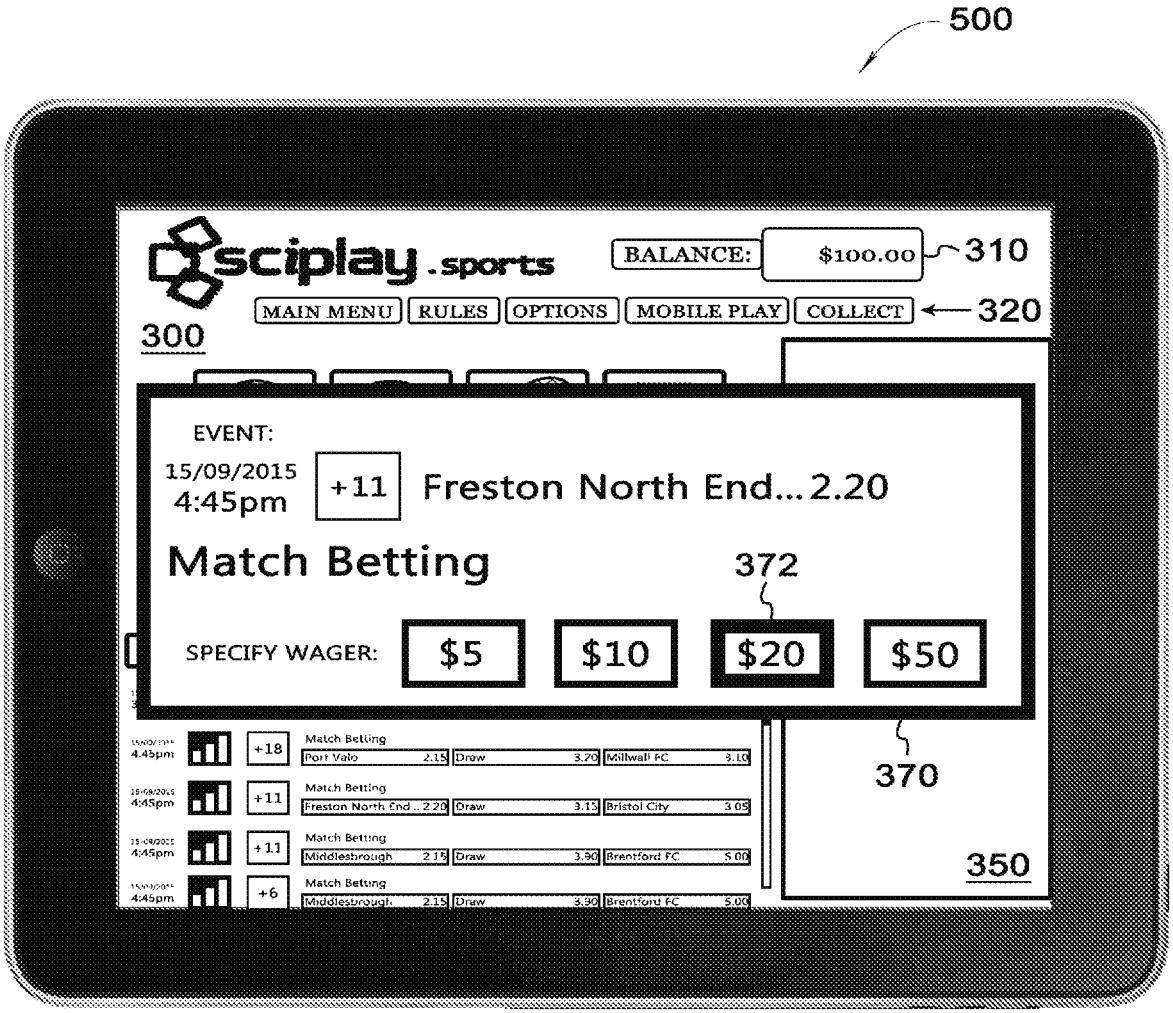
FIG. 5B-5C are images of an exemplary player interface displayed on a gaming machine tablet, according to an embodiment of the present invention.

Referring now to FIG. 5B, a tablet 500 is shown presenting interface 300 to a player in one embodiment. The interface 300 may not be identical to the interface 300 presented on a free standing wagering game machine 102, and may omit options that are not available to mobile players and include additional options that are available or particular to mobile players. The interface 300 includes a credit meter 310 reflecting the balance obtained by determining and retrieving an associated TITO identifier corresponding to the E-tracking ID of ticket 450. The player interacts with the tablet 500 and interface 300 to place a wager using interface 370. The operation of the system in response to player interaction with the interface 300 is parallel to previous discussions (e.g., FIG. 3D).

Figure 5C:
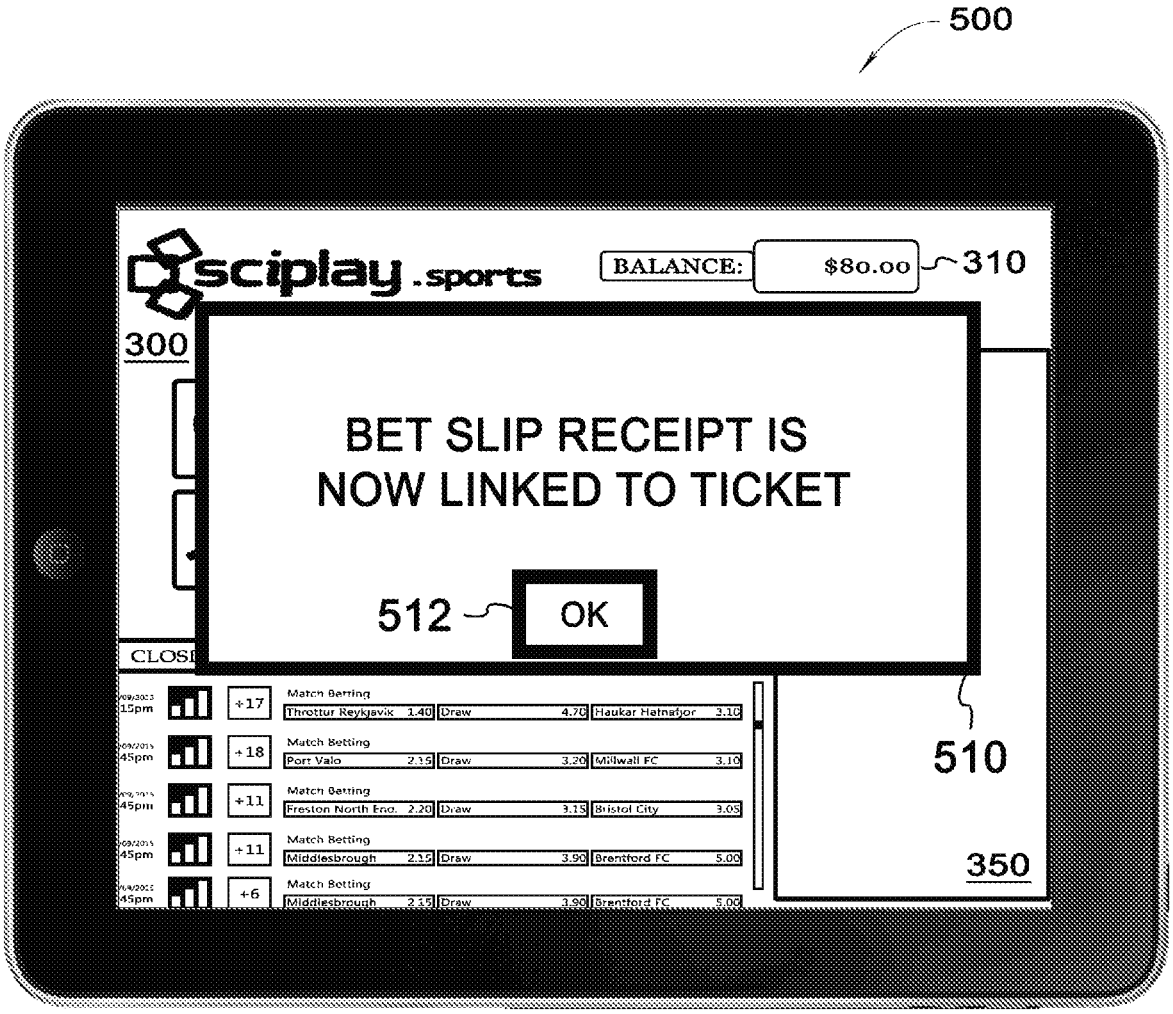

Referring now to FIG. 5C, a dialog box 510 is displayed to the player using interface 300 in one embodiment. In response to placing a wager associated with the anonymous account corresponding to the E-tracking ID encoded on ticket 450, a credit amount covering the wager is deducted from the credit meter 310. A virtual bet slip is generated as a result of this wagering transaction and is associated with the anonymous account (e.g., in a database of the casino accounting system 128). A player acknowledgement of this association may be confirmed by use of a button 512 of the interface 300, e.g., in the dialog box 510.

Figure 6:
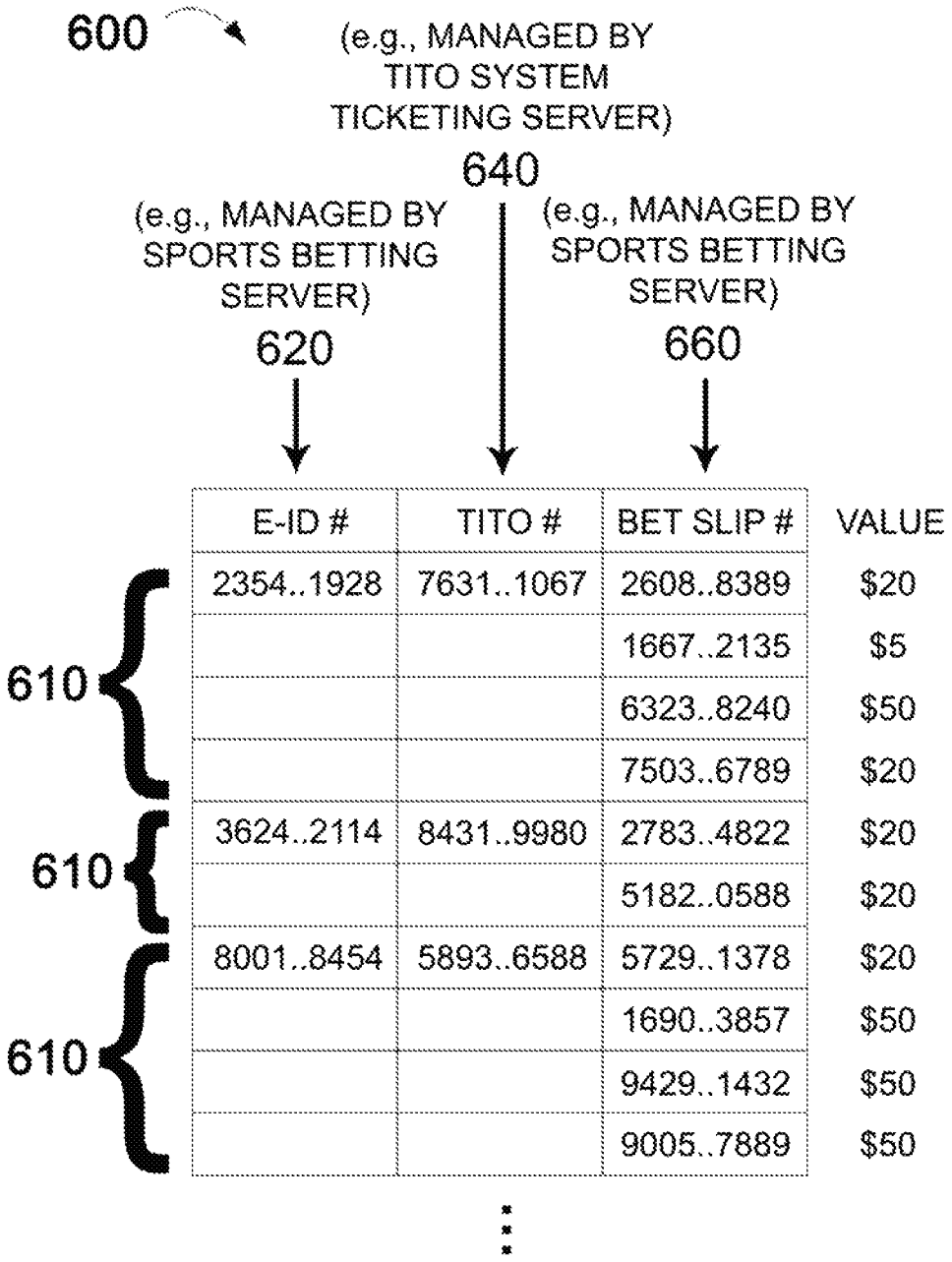
FIG. 6 is an exemplary representation of a database storing related anonymous account identification records, according to an embodiment of the present invention.

Referring now to FIG. 6, a section of the database 600 is shown in one embodiment. The database 600 may be managed by the casino accounting system 128, spanning one or more network entities that access and store information associated with the anonymous player accounts. The database stores a series of database records 610, each including an E-tracking ID 620, a TITO identifier 640, and a bet slip identifier 660. The E-tracking ID 620 corresponds to a unique anonymous player account that is unassociated with any personal information of the player. The E-tracking ID 620 and associated record 610 information is used to designate multiple anonymous wagering transactions with a single player.

The TITO identifier 640 stored for a given record 610 specifies a credit balance that is associated with the anonymous account, if one exists. As the balance changes, and a player places wagers, cashes out, collects winnings, etc., a new TITO identifier is generated and the TITO identifier associated with the E-tracking ID is updated to correspond to the new balance (specified on the TITO ticket). The TITO identifier may be reflected on a cash voucher (e.g., voucher 430) that is disassociated from any E-tracking ID and anonymous account. For example, if a player collects winnings and cashes out leaving the anonymous account with no pending balance and no pending bet slip identifiers 660, the established database record 610 and E-tracking ID 620 may be purged from the database 600. In the event that the player returns to a wagering game machine 102 to anonymously place wagers in the future, a new database record 610 and E-tracking ID 620 will be generated and stored in the database 600.

The bet slip identifier(s) 660 stored for a given record 610 each specify a wagering transaction associated with the anonymous account. Each bet slip identifier 660 has an associated wager amount corresponding to the value of the wager performed in the wagering transaction. Each bet slip identifier 660 may include a plurality of events or other informational entries that are part of the single bet slip resulting from the placed wager (e.g., a single transaction, as in FIG. 4A). In other embodiments, a bet slip may specify a plurality of transactions that are distinct, yet commonly associated with the bet slip identifier.

In one embodiment, a player may approach a kiosk to use a wagering game machine 102, place a wager, and receive the bet slip 410 from the kiosk. Thus, only a single bet slip 410 is associated with the anonymous account. In another embodiment, the player uses the tablet 500 to place a wager and receive a virtual bet slip that is linked to the anonymous account (FIG. 5C). Again, only a single bet slip 660 is associated with the anonymous account.

In another embodiment, in response to a player using a kiosk to place a first wager on a first sporting event, and using the tablet 500 to place a second wager on a second sporting event that is covered by the remaining balance in the anonymous account, the anonymous account has two bet slip identifiers 660 associated therewith. For example, if the sports betting server 124 is used to provide betting information on the sporting events for wagering transactions, the sports betting server may provide first betting information enabling the first wagering terminal to display a first virtual betting slip on the first wagering terminal including an indication of the first wager on the first sporting event, and provide the first betting information and the second betting information to display the first virtual betting slip and a second virtual betting slip on the second wagering terminal including an indication of both the first wager on the first sporting event and the second wager on the second sporting event. In the event that the second wagering terminal is a kiosk or other wagering game machine 102 with a suitable output device, the first and second betting information may be gathered to enable the second wagering terminal to print first and second physical betting slips corresponding to the respective first and second virtual betting slips. In both cases, the first and second virtual betting slip identifiers 660 are associated with the single anonymous account E-tracking identifier 620.

Figure 7:
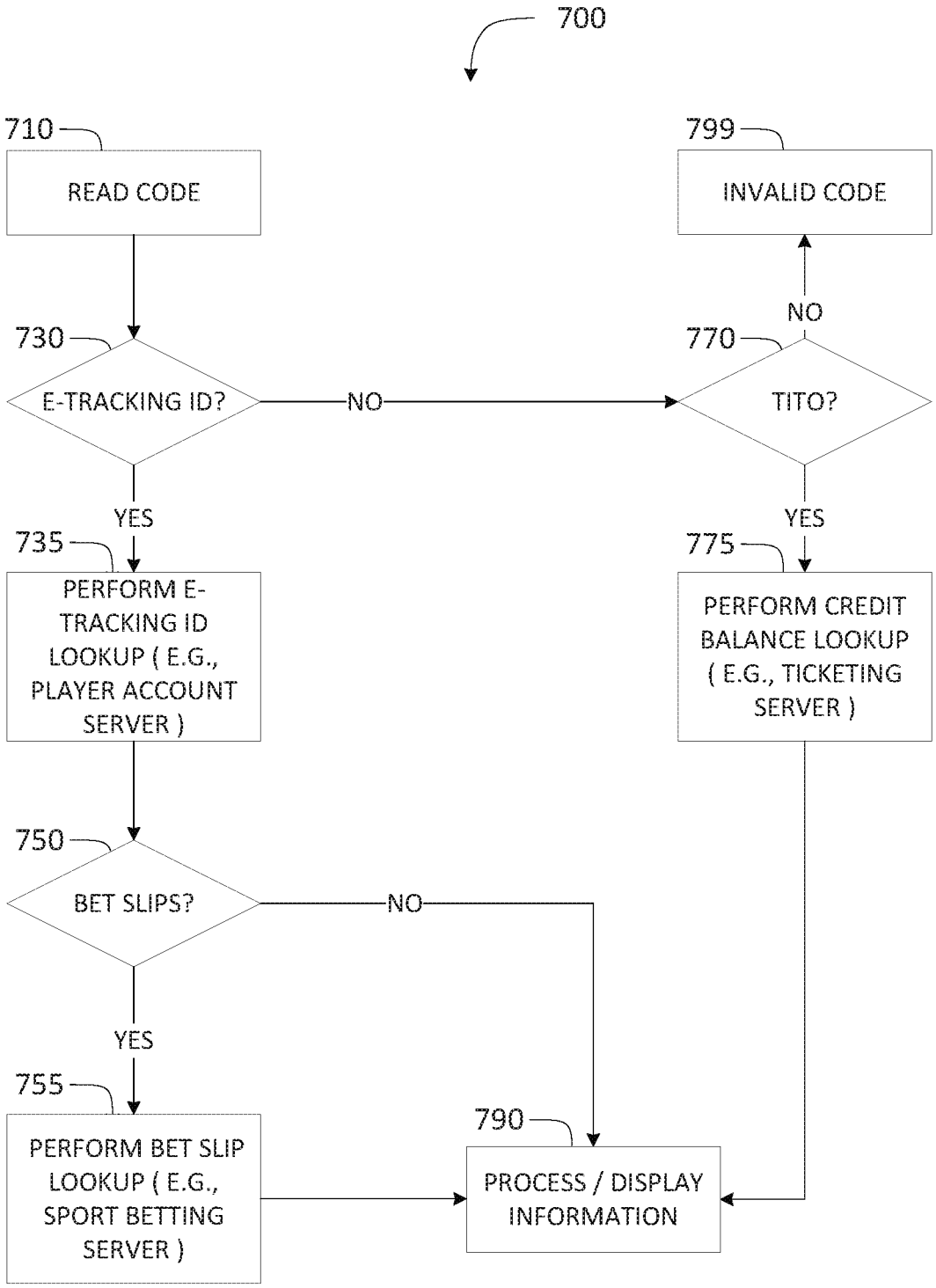
FIG. 7 is a flowchart for a data-processing method corresponding to instructions executed by a controller in accord with at least some aspects of the disclosed concepts.

Referring now to FIG. 7, a data-processing method 700 for processing presented codes at wagering game machine 102 is shown in one embodiment. The method 700 relates to a generalized view of how the system responds to the detection of a code containing an encoded value (e.g., through use of a barcode or some other encoded value presentation as described above) when presented at a wagering game machine 102.

At step 710, the code is presented at the wagering game machine 102 and the code is read. This may involve player interaction through active use of an input device, for example, presenting the bet slip 410, the voucher 430, or the ticket 450 to an optical scanner, entering a code thereon using a keyboard input, or some other method that transfers the code from the player to the wagering game machine 102.

At step 730, a determination is made as to whether the detected code corresponds to an E-tracking identification code, that is, the code corresponds to an anonymous player account represented by the code. If the code does correspond to an established anonymous player account, the details of the account must be accessed and determined, and further lookups may occur as a response. If the code does not correspond to an anonymous player account, further determinations must be made to determine the nature of the code.

At step 735, when it is determined that the code corresponds to an E-tracking identification designation of an anonymous player account, a look up is performed to determine other related values associated with the anonymous player account. For example, this lookup may occur solely using the database 600, or may span many different databases that include the database 600, or portions of the database 600.

Part of the information that may be associated with the E-tracking ID may include a TITO identifier indicating a remaining balance for the anonymous player account. In such a case, a TITO lookup may be made to establish the remaining balance for the account, if required.

At step 750, after any E-tracking ID lookup is conducted, a determination is made as to whether there are any bet slip identifiers associated with the E-tracking ID. If there are associated bet slip identifiers, the information regarding the wagering transactions specified by the bet slip identifiers are determined. If no associated bet slip identifiers exist, no gathering of information is necessary until a wager is placed and a bet slip identifier is associated with the anonymous player account.

At step 755, if there are bet slip identifiers associated with the anonymous player account, a bet slip information lookup is made (to the appropriate network entity, e.g., the sports betting server 124) to retrieve information regarding the wagering transaction specified by each of the bet slip identifiers. The information associated with the bet slip identifier may include significantly more information than just the bet slip identifier 660 stored in the database 600, for example, details of each of the wager transactions (e.g., selected teams, point spreads, etc.), wager amounts, wager placement time, etc.

At step 770, if the detected code is not determined to an E-tracking identification specifying a particular anonymous player account, a determination is made whether the detected code is a TITO identifier, for example, one of the TITO identifiers 640 contained in the database 600. If the code is a TITO identifier, a corresponding balance is determined corresponding to the identifier for display (e.g., using the credit meter 310 of the interface 300). If the code is not a TITO identifier, no TITO lookup is required, potentially causing further analysis of the meaning of the detected code. In the present case, if the detected code is not a TITO identifier, the code is rejected as not being found in any database, or simply invalid due to being improperly detected (step 799).

At step 775, if the detected code is a TITO identifier, a credit balance lookup is performed, for example, by accessing the necessary component(s) of the casino accounting system 128 to properly determine the balance for the anonymous account.

At step 790, in response to all the required or available information being gathered (relating to the scanned code as presented), the information becomes available for processing, presentation, formatting, etc., and selectively displayed. Thus, the information associated with the anonymous player account is processed and displayed. This may include any outstanding balance amount, pending bet slip wager transactions awaiting resolution (e.g., having corresponding awards to settle or refunded due to event cancellation, etc.). Further, any additional information associated with one or more of the identifiers associated with the anonymous player account may also be presented to the player, for example, using interface 300.

FIG. 7, described by way of example above, represents one computer-enabled method corresponding to at least some instructions stored and executed by the game-logic circuitry 240 in FIG. 2 to perform the above described functions associated with the disclosed concepts. Further, other network entities may be involved with the processing of the process defined by FIG. 7, including one or more network entities described or shown in FIG. 1.

Thus, in one embodiment, an express example of operating a sports betting system in accordance with the invention is now described. The player presents cash at a wagering game machine 102 via a bill acceptor. The cash is accepted at the wagering game machine 102 (e.g., a kiosk) and a balance corresponding to the received cash is established with an anonymous account, via one or more controllers of the wagering game machine 102. The anonymous account is identified by a unique ("E-tracking") identifier and is unassociated with any personal information of the player. The identifier is delivered to the player (e.g., visually presented on a video display, printed on a ticket bearing a bar code representing the identifier, send via a text message or e-mail message containing the identifier, etc. In one embodiment, the identifier is delivered to the player by printing a ticket bearing a bar code representing the identifier.

The identifier is subsequently received (e.g., entered or scanned) at a wagering game machine 102 (a first wagering terminal, e.g., a mobile device or a tablet), enabling access to the information of the anonymous account. In one embodiment, the identifier is received at the first wagering terminal by scanning the bar code.

The first wagering terminal is used to generate information indicative of a first wager on a first sporting event covered by the balance in the anonymous account. The first wager is received from the first wagering terminal (by a network entity, e.g. a sports betting server 124) and recorded using the anonymous account identifier. The first wager is now associated with the anonymous account identifier. A wagering game machine 102 (the first wagering terminal or a second wagering terminal) is used to generate information indicative of a second wager on a second sporting event covered by a remaining balance in the anonymous account. The second wager is received from the (first or second) wagering terminal (again, by a network entity, e.g. the sports betting server 124) and recorded using the anonymous account identifier. Both the first and second wagers are now associated with the anonymous account identifier, even when placed on differing wagering terminals.

In one embodiment, a first virtual betting slip is displayed to the player on the first wagering terminal. The first virtual betting slip includes an indication of the first wager on the first sporting event. In another embodiment, the first virtual betting slip and a second virtual betting slip are displayed by the second wagering terminal. The second virtual betting slip includes an indication of the second wager on the second sporting event. In one embodiment, the first and second virtual betting slips are associated with the same identifier, namely, the unique identifier corresponding to the anonymous account.

In one embodiment, the first wagering terminal is a mobile device carried by the player and the second wagering terminal is a kiosk with printing capabilities. In one embodiment the second wagering terminal is the first wagering terminal (e.g., the second wagering terminal is the same kiosk that accepted cash to create and fund the anonymous account).

In one embodiment, the bill acceptor is housed in the second wagering terminal. In one embodiment, first and second physical betting slips corresponding to the respective first and second virtual betting slips are printed at the second wagering terminal.

Each of these embodiments and obvious variations thereof is contemplated as falling within the spirit and scope of the claimed invention, which is set forth in the following claims. Moreover, the present concepts expressly include any and all combinations and subcombinations of the preceding elements and aspects.

What is claimed is:

1. A sports betting server comprising:

at least one processor;

a communications interface configured to communicate via a network; and a memory storage device configured to store instructions, which when executed by the at least one processor, cause the sports betting server to:

in response to accepting cash from a player via a bill acceptor of a kiosk, establish an anonymous account with a balance corresponding to the received cash, the anonymous account being associated with an identifier and being unassociated with any personal information of the player, the balance being transmitted from the kiosk to the sports betting server via the network;

receive the identifier from a first wagering terminal via the network to enable access to the anonymous account;

receive, from the first wagering terminal via the network, a first wager on a first sporting event, the first wager being covered by the balance in the anonymous account;

provide, to the first wagering terminal via the network, first betting information enabling the first wagering terminal to display a first virtual betting slip including an indication of the first wager on the first sporting event;

receive the identifier from a second wagering terminal via the network to enable access to the anonymous account;

receive, from the second wagering terminal via the network, a second wager on a second sporting event, the second wager being covered by a remaining balance in the anonymous account; and provide, to the second wagering terminal via the network, the first betting information and second betting information enabling the second wagering terminal to display the first virtual betting slip and a second virtual betting slip, the second virtual betting slip including an indication of the second wager on the second sporting event.

2. The sports betting server of claim 1, wherein the instructions cause the sports betting server to provide, to the kiosk via the network, the identifier for delivery to the player by at least one of sending a text message containing the identifier, displaying the identifier on a video display, or printing a ticket bearing a bar code representing the identifier.

3. The sports betting server of claim 1, wherein the first and second betting information provided to the second wagering terminal enables the second wagering terminal to print first and second physical betting slips corresponding to the respective first and second virtual betting slips.

4. The sports betting server of claim 1, wherein the first and second virtual betting slips are associated with the identifier.

5. The sports betting server of claim 1, wherein the second wagering terminal is the kiosk or another kiosk, and wherein the first wagering terminal is a mobile device carried by the player.

6. A sports betting kiosk comprising:

an electronic display device;

a bill acceptor; and a controller configured to:

in response to accepting cash from a player via the bill acceptor, transmit balance information to a remote server enabling the remote server to establish an anonymous account with a balance corresponding to the received cash, the anonymous account being associated with an identifier and being unassociated with any personal information of the player;

deliver the identifier to the player, the identifier being receivable at a first wagering terminal to enable access to the anonymous account and receipt of a first wager on a first sporting event, the first wager being covered by the balance in the anonymous account, the first wagering terminal being configured to receive, from a sports betting server via a network, first betting information enabling the first wagering terminal to display a first virtual betting slip including an indication of the first wager on the first sporting event;

receive the identifier to enable access to the anonymous account; and receive a second wager on a second sporting event, the second wager being covered by a remaining balance in the anonymous account, the second wagering terminal being configured to receive, from the sports betting server via the network, the first betting information and second betting information enabling the second wagering terminal to display the first virtual betting slip and a second virtual betting slip, the second virtual betting slip including an indication of the second wager on the second sporting event.

7. The sports betting kiosk of claim 6, wherein the controller is configured to deliver the identifier by at least one of sending a text message containing the identifier, displaying the identifier on the electronic display device, or printing a ticket bearing a bar code representing the identifier.

8. The sports betting kiosk of claim 6, further including a ticket printer, wherein the controller is configured to cause the ticket printer to print first and second physical betting slips corresponding to the respective first and second virtual betting slips.

9. The sports betting kiosk of claim 6, wherein the first and second virtual betting slips are associated with the identifier.

10. The sports betting kiosk of claim 6, wherein the kiosk includes a bar code scanner, wherein the identifier is represented by a bar code on a ticket, and wherein the controller is configured to receive the identifier in response to the bar code scanner reading the bar code on the ticket.

11. A method of operating a sports betting system, comprising:

accepting cash from a player via a bill acceptor;

establishing, by a controller, an anonymous account with a balance corresponding to the received cash, the anonymous account being associated with an identifier and being unassociated with any personal information of the player;

delivering the identifier to the player;

receiving the identifier at a first wagering terminal to enable access to the anonymous account;

receiving, via the first wagering terminal, a first wager on a first sporting event, the first wager being covered by the balance in the anonymous account;

providing, to the first wagering terminal, first betting information enabling the first wagering terminal to display a first virtual betting slip including an indication of the first wager on the first sporting event;

receiving the identifier at a second wagering terminal to enable access to the anonymous account;

receiving, via the second wagering terminal, a second wager on a second sporting event, the second wager being covered by a remaining balance in the anonymous account; and providing, to the second wagering terminal, the first betting information and second betting information enabling the second wagering terminal to display the first virtual betting slip and a second virtual betting slip, the second virtual betting slip including an indication of the second wager on the second sporting event.

12. The method of claim 11, wherein the delivering includes at least one of sending a text message containing the identifier, displaying the identifier on a video display, or printing a ticket bearing a bar code representing the identifier.

13. The method of claim 11, further including printing, by the second wagering terminal, first and second physical betting slips corresponding to the respective first and second virtual betting slips.

14. The method of claim 11, wherein the first and second virtual betting slips are associated with the identifier.

15. The method of claim 11, wherein the second wagering terminal is a kiosk and the first wagering terminal is a mobile device carried by the player.

16. The method of claim 11, wherein the delivering includes printing a ticket bearing a bar code representing the identifier, and wherein receiving the identifier at the first wagering terminal includes scanning the bar code.

17. The method of claim 11, wherein the bill acceptor is housed in the second wagering terminal.

* * * * *